US010665385B2

(12) United States Patent
Gardner

(10) Patent No.: US 10,665,385 B2
(45) Date of Patent: May 26, 2020

(54) INTEGRATED INDUCTOR WITH ADJUSTABLE COUPLING

(71) Applicant: Intel Corporation, Santa Clara, CA (US)

(72) Inventor: Donald S. Gardner, Los Altos, CA (US)

(73) Assignee: Intel Corporation, Santa Clara, CA (US)

( * ) Notice: Subject to any disclaimer, the term of this patent is extended or adjusted under 35 U.S.C. 154(b) by 150 days.

(21) Appl. No.: 15/283,351

(22) Filed: Oct. 1, 2016

(65) Prior Publication Data

US 2018/0096776 A1 Apr. 5, 2018

(51) Int. Cl.

| | |
|---|---|
| ***H01F 27/28*** | (2006.01) |
| ***H01F 41/02*** | (2006.01) |
| ***H01F 41/04*** | (2006.01) |
| ***H01F 17/00*** | (2006.01) |

(52) U.S. Cl.

CPC ..... *H01F 41/0213* (2013.01); *H01F 17/0006* (2013.01); *H01F 41/046* (2013.01); *H01F 2017/0066* (2013.01)

(58) Field of Classification Search

CPC ..... H01F 27/2804; H01F 27/25; H01F 27/24; H01F 27/2847; H01F 2017/0086; H01F 41/0213; H01F 41/046

USPC ..... 336/212, 221, 220, 178

See application file for complete search history.

(56) References Cited

U.S. PATENT DOCUMENTS

| | | | | |
|---|---|---|---|---|
| 8,102,236 | B1 * | 1/2012 | Fontana, Jr. | H01F 17/0006 336/200 |
| 2005/0156704 | A1 | 7/2005 | Gardner et al. | |
| 2006/0192646 | A1 * | 8/2006 | Hanley | H01F 17/06 336/200 |
| 2008/0238602 | A1 | 10/2008 | Schrom et al. | |
| 2009/0091414 | A1 * | 4/2009 | Hopper | H01F 17/0013 336/212 |
| 2013/0055556 | A1 | 3/2013 | Hanseh | |
| 2013/0106552 | A1 * | 5/2013 | Fontana, Jr. | H01F 17/0013 336/200 |
| 2014/0264732 | A1 | 9/2014 | Elsherbini et al. | |
| 2014/0266558 | A1 * | 9/2014 | Catalano | H01F 3/14 336/233 |

OTHER PUBLICATIONS

K. D. T. Ngo, et al., "Effects of Air Gaps on Winding Loss in High-Frequency Planar Magnetics," in Power Electronics Specialists Conference, 1988. PESC '88 Record, 19th Annual IEEE, 1988, pp. 1112-1119 vol. 2.

(Continued)

*Primary Examiner* — Mang Tin Bik Lian

(74) *Attorney, Agent, or Firm* — Schwabe, Williamson & Wyatt P.C.

(57) ABSTRACT

Embodiments are generally directed to an integrated inductor with adjustable coupling. In some embodiments, an integrated inductor includes a first conductor and a second conductor; a first strip of magnetic material film below the first conductor and the second conductor; and a second strip of magnetic material film above the first conductor and the second conductor, wherein at least one of the first strip of magnetic material and the second strip of magnetic material includes a partial slot to partially separate a first section of the strip of magnetic material and a second section of the strip of magnetic material.

8 Claims, 13 Drawing Sheets

(56) References Cited

OTHER PUBLICATIONS

Lim, M. H., et al., "Effect of Geometry Variation of LTCC Distributed Air-Gap Filter Inductor on Light Load Efficiency of DC-DC Converters," Industry Applications Conference, 2006. 41st IAS Annual Meeting. Conference Record of the 2006 IEEE, 2006, pp. 1884-1890.
International Search Report and Written Opinion for PCT/US2017/049227, dated Dec. 28, 2017, 12 pages.
International Preliminary Report Patentability for PCT/US2017/049227, dated Apr. 11, 2019, 9 pages.

* cited by examiner

INTEGRATED INDUCTOR WITH ADJUSTABLE COUPLING

TECHNICAL FIELD

Embodiments described herein generally relate to the field of electronic devices and, more particularly, an integrated inductor with adjustable coupling.

BACKGROUND

In microelectronic circuits, integrated inductors are utilized to provide functions including on-die power delivery. Air-core inductors (ACIs) are commonly being utilized, and may be built in an electronic package underneath each microprocessor core. In this manner, the conventional inductor is a separate component from the other circuitry of the microelectronic circuit.

Air-core inductors (referring to an inductor that does not depend on ferromagnetic material to provide inductance) present a difficulty in scaling with the reduction in area for microprocessors resulting as microelectronics move to finer process geometries. In particular, the quality factor of the air-core inductor is generally decreasing with each generation of microprocessor. In addition, to minimize eddy current effects, the air-core inductors generally cannot have metallization or conductors such as interconnections located near to them (i.e. above or below the inductor), and as a result the inductors require a large volume.

Integrated inductors that include magnetic materials (which may be referred to herein as magnetic material inductors) can provide an alternative to air-core inductors to mitigate the area scaling trends and help maintain good efficiency at low currents. However, the implementation of magnetic materials for micro integrated inductors introduces certain difficulties. In particular, eddy currents present a significant challenge with conductive magnetic materials, greatly reducing the quality factor for such integrated inductors.

BRIEF DESCRIPTION OF THE DRAWINGS

Embodiments described here are illustrated by way of example, and not by way of limitation, in the figures of the accompanying drawings in which like reference numerals refer to similar elements.

DETAILED DESCRIPTION

Figure 1:
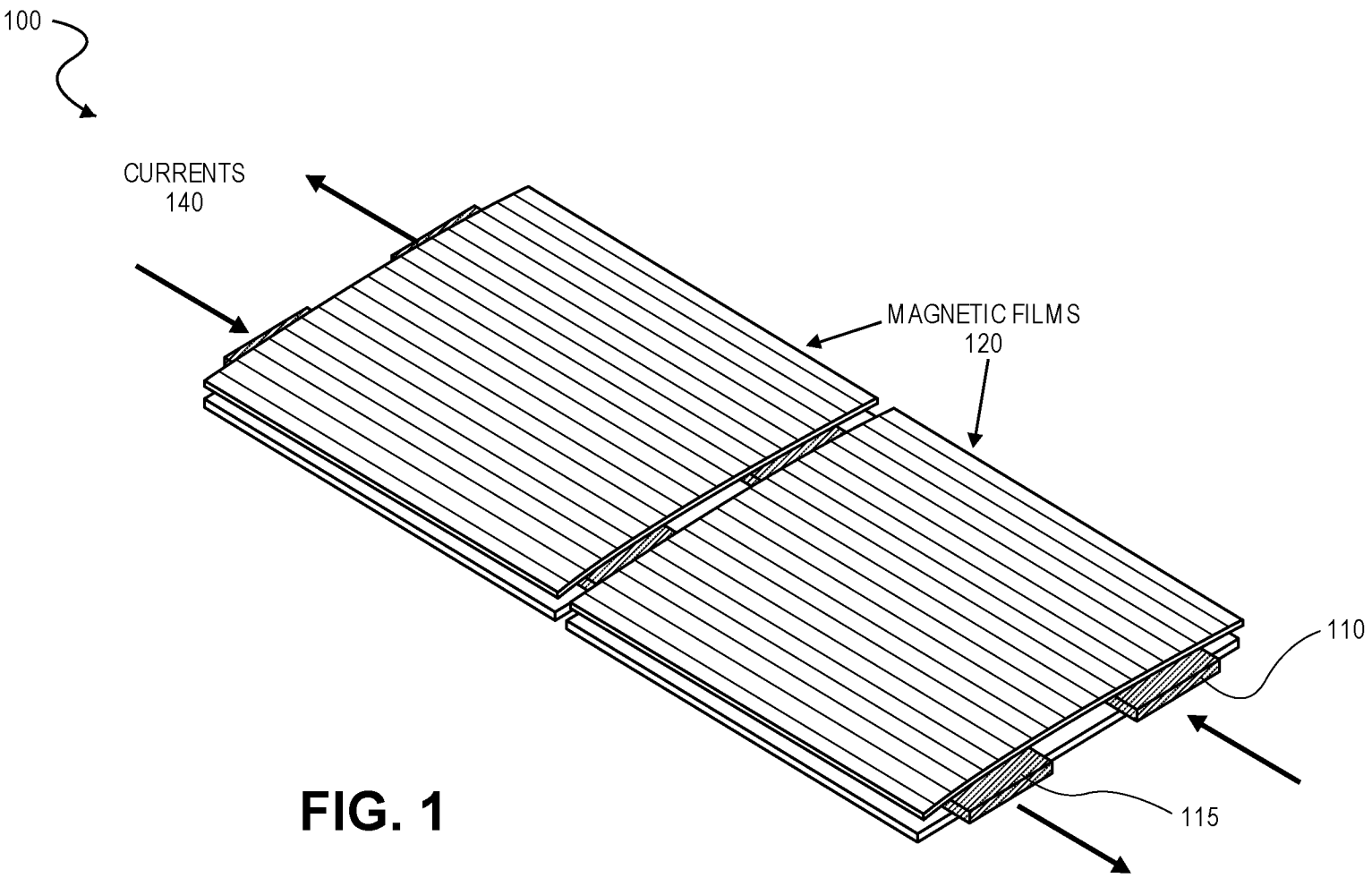
FIG. 1 is an illustration of an integrated inductor that includes a patterned magnetic film material.

Embodiments described herein are generally directed to an integrated inductor with adjustable coupling. In some embodiments, an integrated inductor is provided for implementations that may include power delivery, power amplifiers, or applications that require an inductor with magnetic coupling.

For the purposes of this description:

"Integrated inductor" refers to inductor that is integrated onto a substrate of a microelectronic package or chip. The term "integrated inductor" includes integration on a chip (for example, integration into a system on a chip, or SoC), integration on a package (for example, integration into a system on a package, or SoP), integration into a die that is separate from other circuitry, or other integration into a substrate.

"Eddy current" refers to an electric current in a conductor resulting from induction by a flowing or varying current, wherein eddy currents are in the form of closed loops and tend to flow counter to the flow of electric currents in the interconnections.

"Quality factor" or"Q" of an inductor refers to a measure of the efficiency of the inductor, wherein Q equals a ratio of inductive reactance to resistance at a given frequency.

Coupled integrated inductors and transformer structures using magnetic films may be implemented in microelectronic circuits such as integrated voltage converters. Magnetic material inductors (which may also be referred to as magnetic-core inductors, or MCI) use less volume than inductors without magnetic materials, and therefore will enable scaling to smaller microprocessor elements. However, the challenges faced in implementing conductive magnetic materials in integrated inductors include the generation of eddy currents in the magnetic material and the fact that the magnetic material can reach saturation in operation, causing a drop in the inductance at higher currents. The saturation of the magnetic material is in contrast with an air core inductor that does not include magnetic material, and which cannot saturate.

The difficulties with saturation can be reduced by using a magnetic material that includes an air gap, but with the resulting disadvantage of a reduction in the effective permeability of the magnetic material, $\mu_e$. Flux density, referring to the magnitude of magnetic flux passing through a unit area, may be determined as follows:

$$B=\mu_0\times\mu_e\times H \quad [1]$$

Where: B=magnetic flux density (B field)

$\mu_e$=effective permeability of the magnetic material $\mu_0$=permeability of a vacuum H=magnetic field The flux density will decrease with a lower effective permeability $\mu_e$ of the magnetic material. This will result in a reduction in inductance, and the reduction in inductance can only be compensated for by increasing the length of the inductor or the number of winding turns in a solenoid structure.

In implementation, an integrated inductor may be implemented to include a break in the conductive paths of the magnetic material, wherein the breaks in the conductive paths operate to reduce the eddy currents. However, the breaks in the magnetic material results in a reduction in the inductance and corresponding quality factor of the inductor, resulting in losses in operation.

In some embodiments, to address the limitations of a magnetic material structure for an integrated inductor, a coupled transformer structure with magnetic material includes adjustable coupling between portions of the transformer without requiring change in process technology for fabrication of the inductor. In some embodiments, connection of strips of the magnetic material of an integrated inductor may be adjusted by changing the mask design and layout for the device, thereby modifying the coupling factor for the inductor. In some embodiments, the coupling factor may be chosen for a given circuit design while minimizing the eddy currents that create loss. In some embodiments, a process enables a choice of frequency at which the peak quality factor for the inductor occurs, thereby maximizing the efficiency for a voltage converter, power amplifier, or other circuit.

FIG. 1 is an illustration of an integrated inductor that includes a patterned magnetic film material. As illustrated in FIG. 1, a coupled integrated inductor 100 includes two conductors such as two copper wires 110 and 115 surrounded by strips of magnetic film material 120 below and above the copper wires. The inductor 100 may be referred to as a stripe inductor or microstrip inductor. There are varying currents 140 flowing through the copper wires 110-115. In this implementation, there are air gaps on the sides (without magnetic vias). Further, the magnetic material 120 is made of two parts to reduce the eddy currents.

However, the implementation illustrated in FIG. 1 will generate significant eddy currents within each portion of the magnetic material 120 as there is no impediment to the eddy current flow within such portions.

Figure 2:
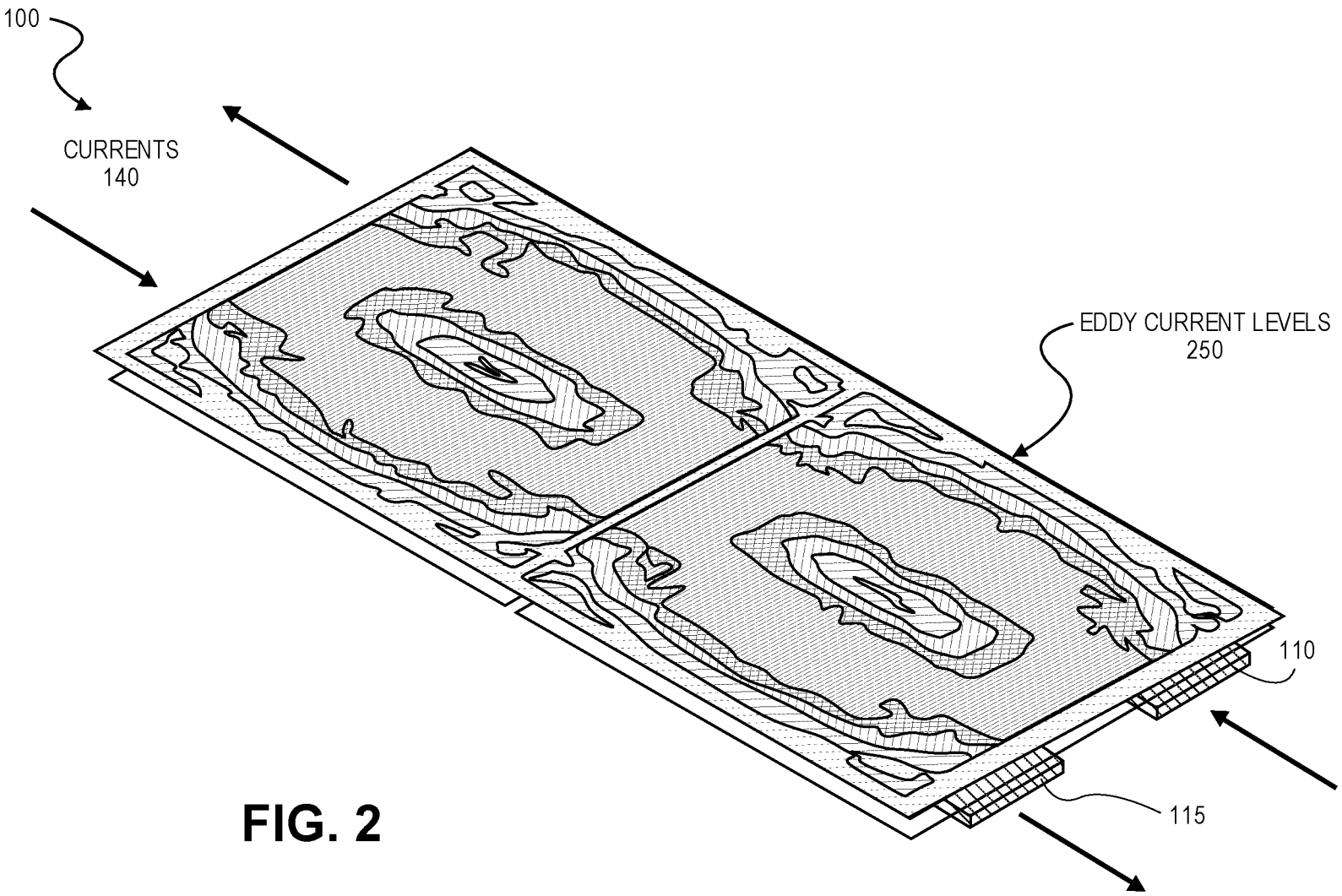
FIG. 2 is a 3D (three-dimensional) illustration of eddy current densities generated in an integrated inductor that flow in a patterned magnetic film material.

FIG. 2 is a 3D illustration of eddy current levels generated in an integrated inductor including a patterned magnetic film material. As provided in FIG. 2, the integrated inductor 100 again includes varying currents 140 flowing through conductors 110 and 115, which may include copper wires. In FIG. 2, a simulation is provided showing the magnitude of eddy currents 250 in the magnetic material in the coupled inductor design using magnetic material. In this illustration, the portions of the eddy currents 250 indicated with darker and more dense (closer spaced) lines indicate higher levels of current flow. While the levels of the eddy currents 250 are lower in comparison with a structure including one or more magnetic vias, the currents are still large enough to cause degradation in the quality factor of the inductor.

Figure 3:
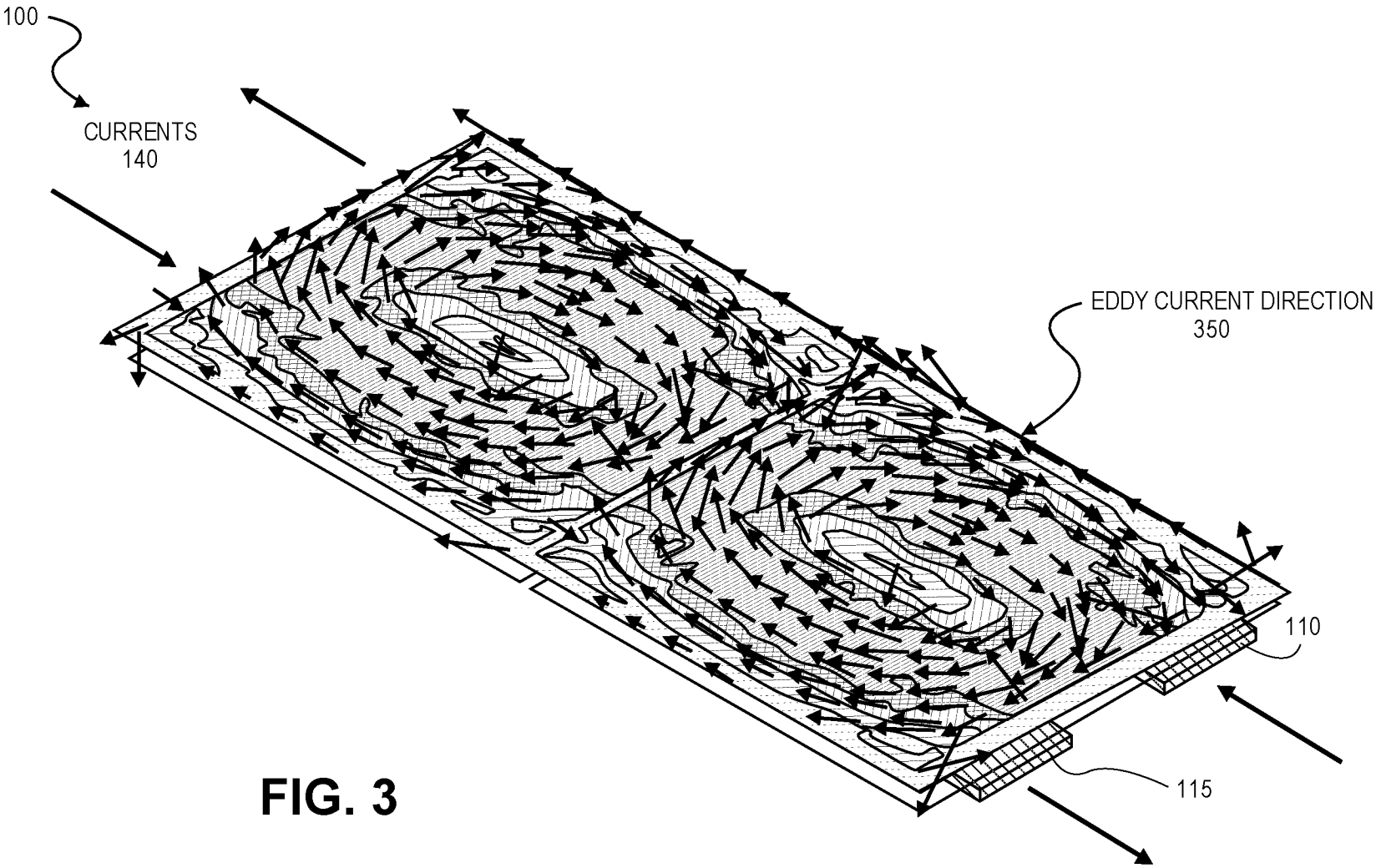
FIG. 3 is a 3D illustration of the direction of the eddy currents generated in an integrated inductor that flow in a patterned magnetic film material.

FIG. 3 is a 3D illustration of the direction of the eddy currents generated in an integrated inductor including a patterned magnetic film material. As provided in FIG. 3, the integrated inductor 100 again includes varying currents 140 flowing through conductors 110 and 115. In FIG. 3, vectors 350 are provided to illustrate the direction of the eddy currents in the magnetic material. As illustrated by the vectors 350, there is no impediment to the flow of eddy currents in the strips of magnetic material.

Figure 4:
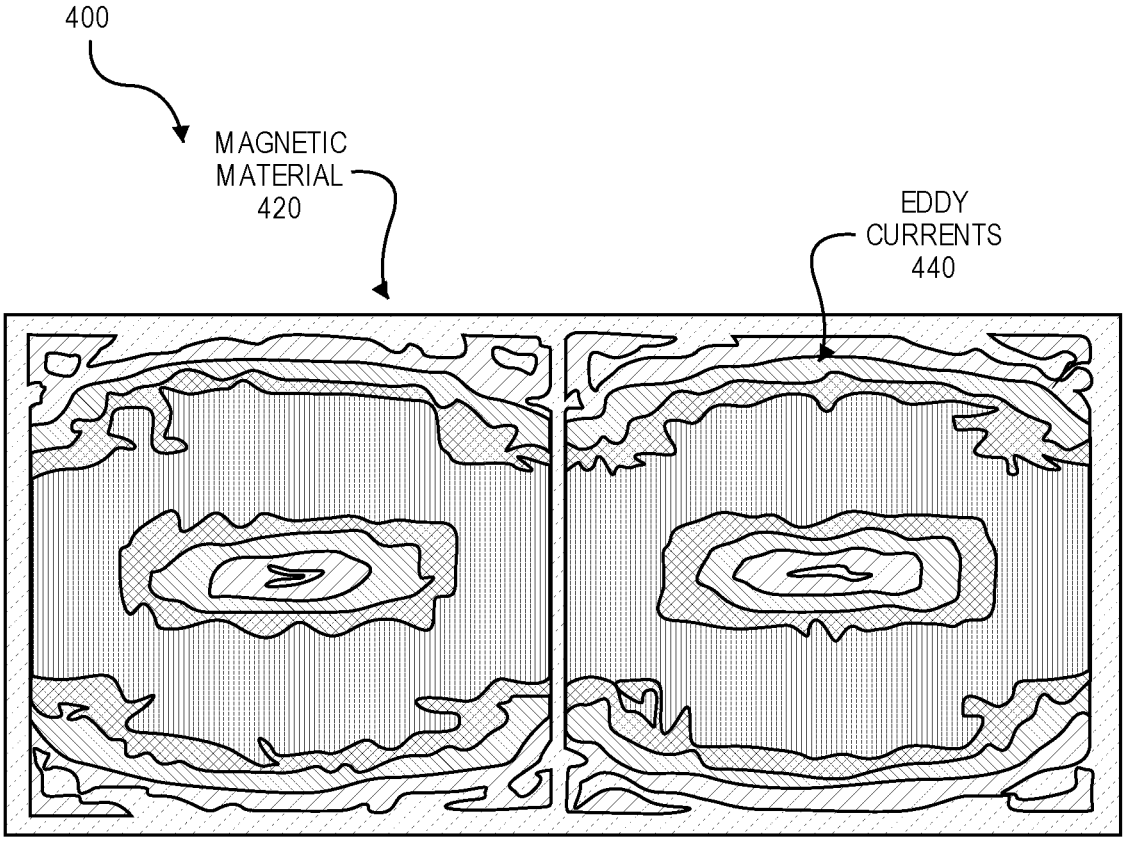
FIG. 4 is a 2D (two-dimensional) illustration of a patterned magnetic film material.

FIG. 4 is a 2D illustration of an integrated inductor including a patterned magnetic film material. As illustrated in FIG. 4, the magnetic material 420 of a coupled integrated inductor 400 (viewed from above) produces significant eddy currents 440. As illustrated, there is no obstruction to the flow of the eddy currents 440 through each portion of the magnetic material 420. Portions of the eddy currents 440 having darker and more dense lines indicate higher eddy current levels and portions having lighter and less dense lines indicate lower eddy current levels.

Figure 5A:
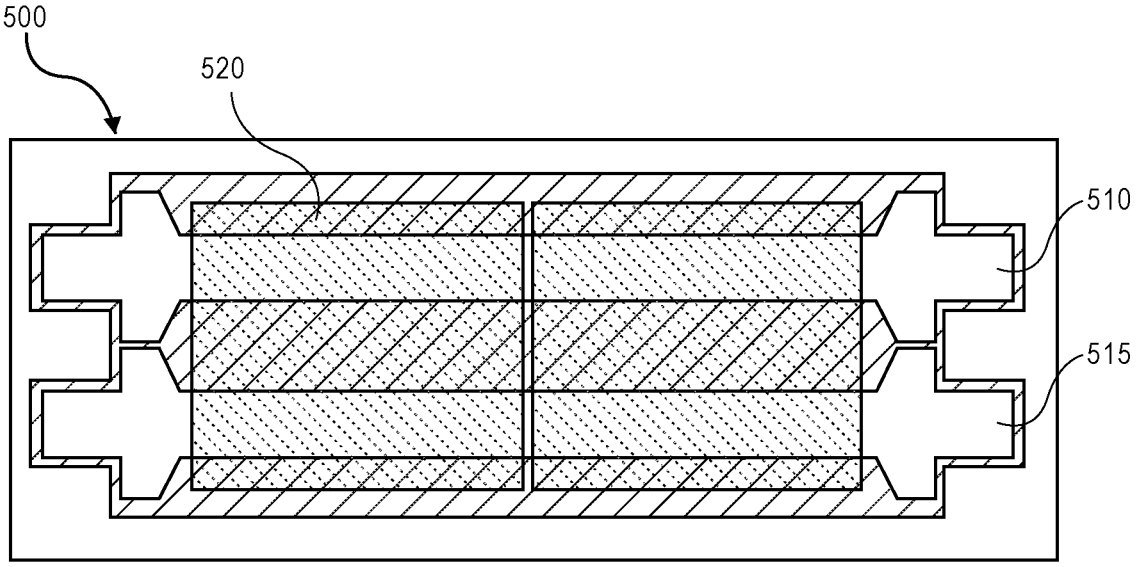
FIG. 5A is a representation of a microscopic image of an integrated inductor including a patterned magnetic film material.

FIG. 5A is a representation of an integrated inductor including a patterned magnetic film material. As illustrated in FIG. 5A, a coupled integrated inductor 500 includes conductors 510 and 515 surrounded above and below by strips of magnetic film material 520. As provided in this illustration, the magnetic material 520 of the coupled integrated inductor 500 (viewed from above) does not include any lengthwise separation of the strips of magnetic material 520, in a similar construction to the inductors illustrated in FIGS. 1-4. As illustrated, there is no obstruction to the flow of the eddy currents through each portion of the magnetic material 520. Stated in another way, the integrated inductor 500 includes strongly-coupled structures with no lengthwise separation in the magnetic material.

Figure 5B:
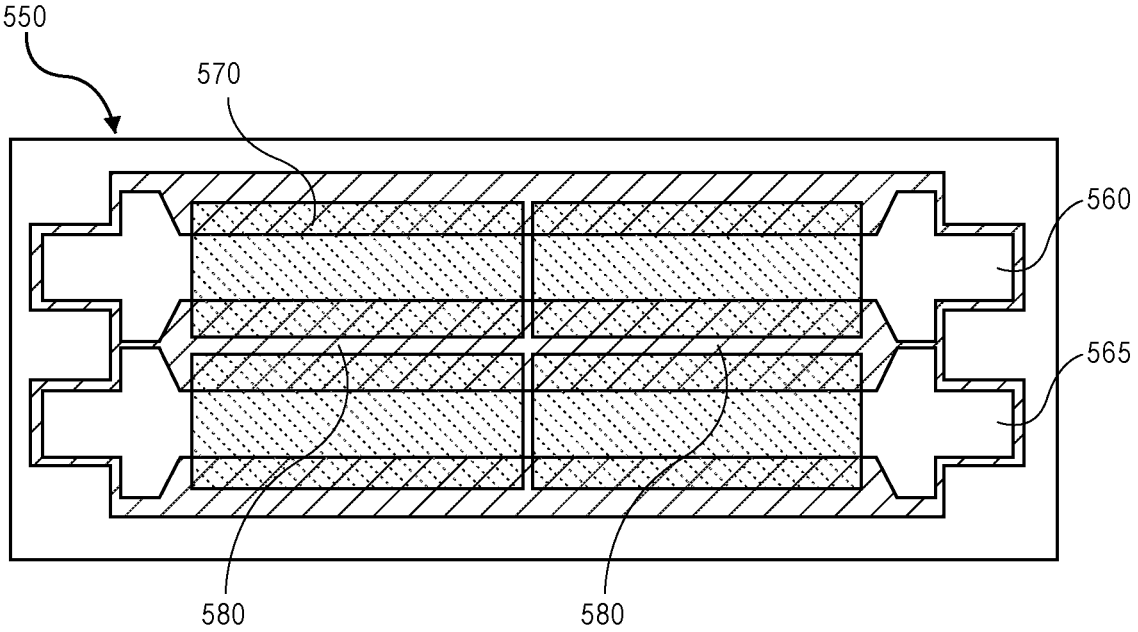
FIG. 5B is a representation of a microscopic image of an integrated inductor including a patterned magnetic film material with full gap separation of the magnetic material.

FIG. 5B is a representation of a microscopic image of an integrated inductor including a patterned magnetic film material with full gap separation of the magnetic material. As illustrated in FIG. 5B, a coupled integrated inductor 550 includes conductors 560 and 565 surrounded above and below by magnetic material 570. As provided in FIG. 5B, to provide control of the eddy currents, slots 580 are implemented to separate the strips of magnetic material 570 of the integrated inductor 550 by a gap, the gap being parallel to the conductors 560 and 565 of the inductor device 550. Stated in another way, the integrated inductor 550 includes weakly-coupled structures with a full lengthwise separation in the strip of magnetic material.

However, the slots 580 are fabricated orthogonal to the direction of the current flowing in the wires, without regard to such parameters as the coupling factor and the complex flows of the eddy currents. As further described below, the implementation of the slots 580, while reducing eddy currents, also serves to significantly reduce the quality factor of the inductor 550.

In some embodiments, an integrated inductor is modified to provide magnetic material structures that can address the complex flows of the eddy currents in the magnetic material, and that can be tuned to better meet the circuit requirements by adjusting one or more characteristics of the inductor. In some embodiments, an apparatus, system, or process is to partially separate the magnetic material located over each microstrip inductor such that the coupling between the magnetic strip sections is higher than a weakly coupled structure (such as illustrated in FIG. 5B), but provides a structure that does not result in excessively high levels of eddy currents. As described herein, an inductor including partially separated magnetic film material sections may be referred to as an H-gap inductor structure (referred to because the magnetic material is in approximately the shape of a letter "H" when including the partial gap separation of such material).

The H-gap transformer inductor may include the following:

(1) In some embodiments, a discontinuous gap is implemented between the magnetic films above and below the coupled stripe inductors making up the transformer. In some embodiments, a size of the gap may be adjusted both to select the desired coupling of the inductor and to set the frequency of the peak quality factor for the inductor. In some embodiments, gap adjustment may be implemented by changing a mask design and layout or similar structure for fabrication of the integrated inductor without requiring a change in the materials or process technology for the integrated inductor.

(2) In some embodiments, additional gaps (referred to herein as notches) along an outer periphery of the magnetic material may be implemented to adjust the coupling between the top and bottom magnetic films and to further reduce the eddy currents in the magnetic material.

(3) In some embodiments, the integrated inductor may be implemented such that the conductor is fabricated directly in contact with the bottom magnetic film layer by creating a complete gap between the two sides. This construction eliminates one dielectric layer film. The high resistivity and laminations of the magnetic material minimize the flow of current between the two copper stripes when some magnetic material is used to bridge the magnetic material that is used to form the H-gap structure.

(4) In some embodiments, the adjustable gaps may be designed into transformer structures fabricated into trenches etched into the silicon substrate.

In some embodiments, an adjustable gap architecture may be implemented in inductors or transformers with magnetic materials in, for example, RF circuits, wireless circuits, or power amplifiers, or to integrate a high-frequency DC-DC converter to better control power consumption in high performance or low power devices and circuits. In some embodiments, the implementation of the adjustable gap architecture may be particularly valuable in multicore and graphics microprocessors. However, embodiments are not limited to these implementations, but rather be utilized in any microelectronic circuit.

Figure 6A:
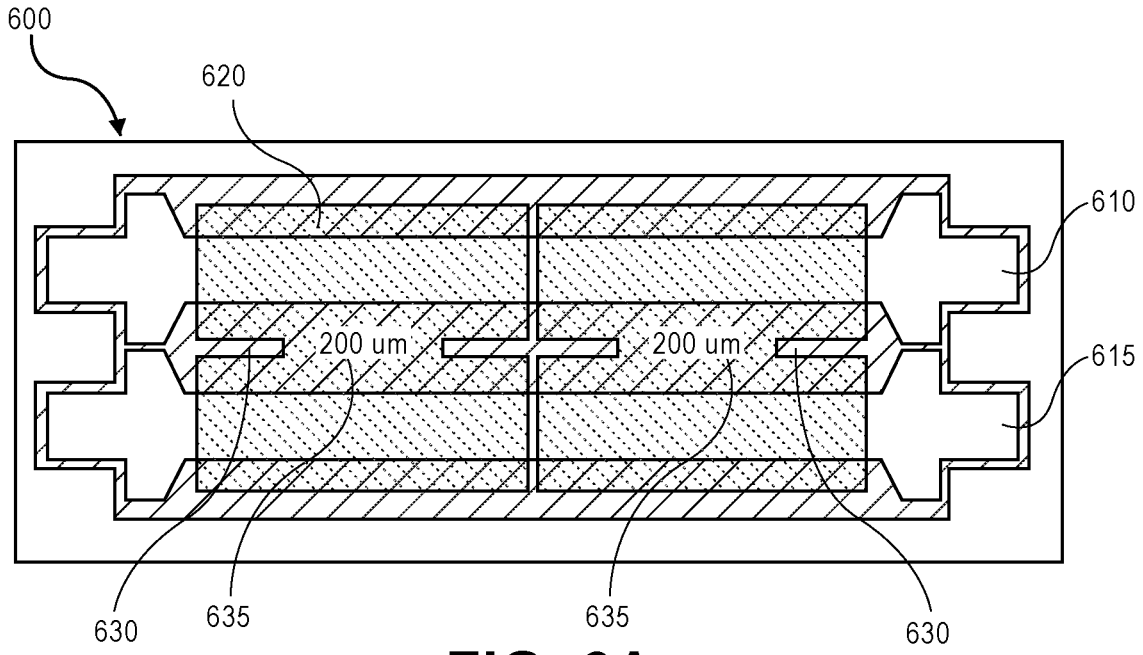
FIG. 6A is a representation of a first microscopic image of an integrated inductor with a magnetic film material including a partial gap separation of the magnetic material according to an embodiment.

FIG. 6A is a representation of a first microscopic image of an integrated inductor with a magnetic film material including a partial gap separation of the magnetic material according to an embodiment. As illustrated in FIG. 6A, a coupled integrated inductor 600 includes conductors 610 and 615 surrounded above and below by a strip of magnetic material 620. In some embodiments, to provide control of the eddy currents as well as to enable improved and tunable response by the inductor 600, partial slots 630 (which may also be referred to as partial gaps) may be implemented to partially separate the materials in the integrated inductor 600, the partial slots resulting in partial bridges 635 of the magnetic material 620. In this instance, the width of the bridge 635 is 200 μm (micrometers, or microns). In some embodiments, the integrated inductor 600 includes moderately coupled structures with a 200 micron bridge of magnetic material within the strip of magnetic material.

Figure 6B:
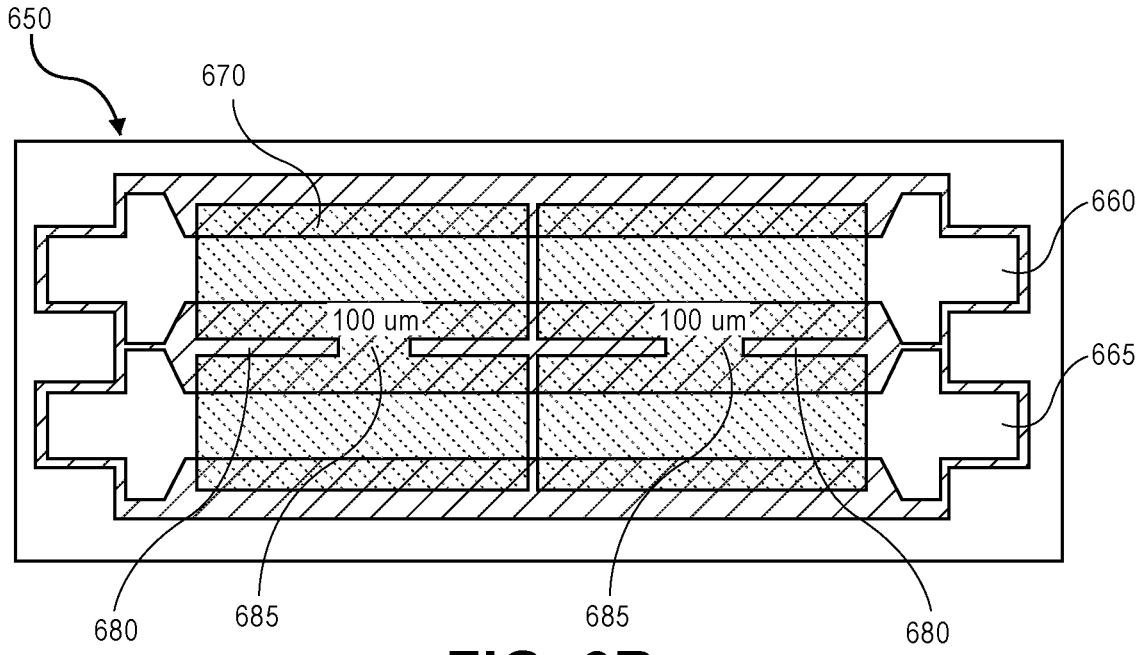
FIG. 6B is a representation of a second microscopic image of an integrated inductor with a magnetic film material including a partial gap separation of the magnetic material according to an embodiment.

FIG. 6B is a representation of a second microscopic image of an integrated inductor with a magnetic film material including a partial gap separation of the magnetic material according to an embodiment. As illustrated in FIG. 6B, a coupled integrated inductor 650 includes conductors 660 and 665 surrounded above and below by magnetic material 670. In some embodiments, partial slots 680 are again implemented to partially separate the materials in the integrated inductor 650, the partial slots resulting in partial bridges 685 of the magnetic material 670. In this instance, the width of the bridge 685 is 100 μm. In some embodiments, the integrated inductor includes moderately coupled structures with a 100 micron bridge of magnetic material in the strip of magnetic material.

In some embodiments, the width of the bridges of magnetic material may be set at any width between the unseparated implementation illustrated in FIG. 5A and the fully separated implementation illustrated in FIG. 5B. In some embodiments, a width of a bridge of magnetic material may be within a range of percentages of the full length of the magnetic material. In first example, the width of a bridge may be at least 10% and no more than 90% of the full length of the magnetic material. In a second example, the width of a bridge may be at least 20% and no more than 80% of the full length of the magnetic material. A width of a bridge of magnetic material in an inductor may commonly be no more than 50% of the total length of the magnetic material, but the precise width will depend on the particular design of the inductor. In the particular examples illustrated in FIGS. 6A and 6B, the bridge 635 in FIG. 6A has a width of approximately 40% of the total length of the magnetic material, and the bridge 685 in FIG. 6B has a width of approximately 20% of the total length of the magnetic material.

In some embodiments, the partial slots are implemented to include a first slot portion beginning at a point on a first end of a section of magnetic material (in a first direction along the conductors) and a second slot portion beginning at a point on a second, opposite end of the magnetic material (in a second opposite direction along the conductors), with the bridge of magnetic material being between the first slot portion and the second slot portion. In some embodiments, a bridge between the first slot portion and the second slot portion may be any width greater than zero. In some embodiments, a width of a bridge of magnetic material may be within a range of percentages of the full length of the magnetic material. In some embodiments, the bridge located is approximately at a middle of the section of magnetic material between the first end and the second end, or, stated in another way, the first slot portion and the second slot portion are approximately the same length. In some embodiments, a midpoint between the first end and the second end of the magnetic material is included in the bridge. In some embodiments, the partial slots are approximately parallel with the conductors, which may be referred to as being positioned lengthwise in the magnetic material. In some embodiments, each partial slot is located approximately midway between a first conductor and a second conductor. In some embodiments, the partial gap (and thus the bridge of magnetic material) in the top magnetic film and the bottom magnetic film may be different.

Figure 7:
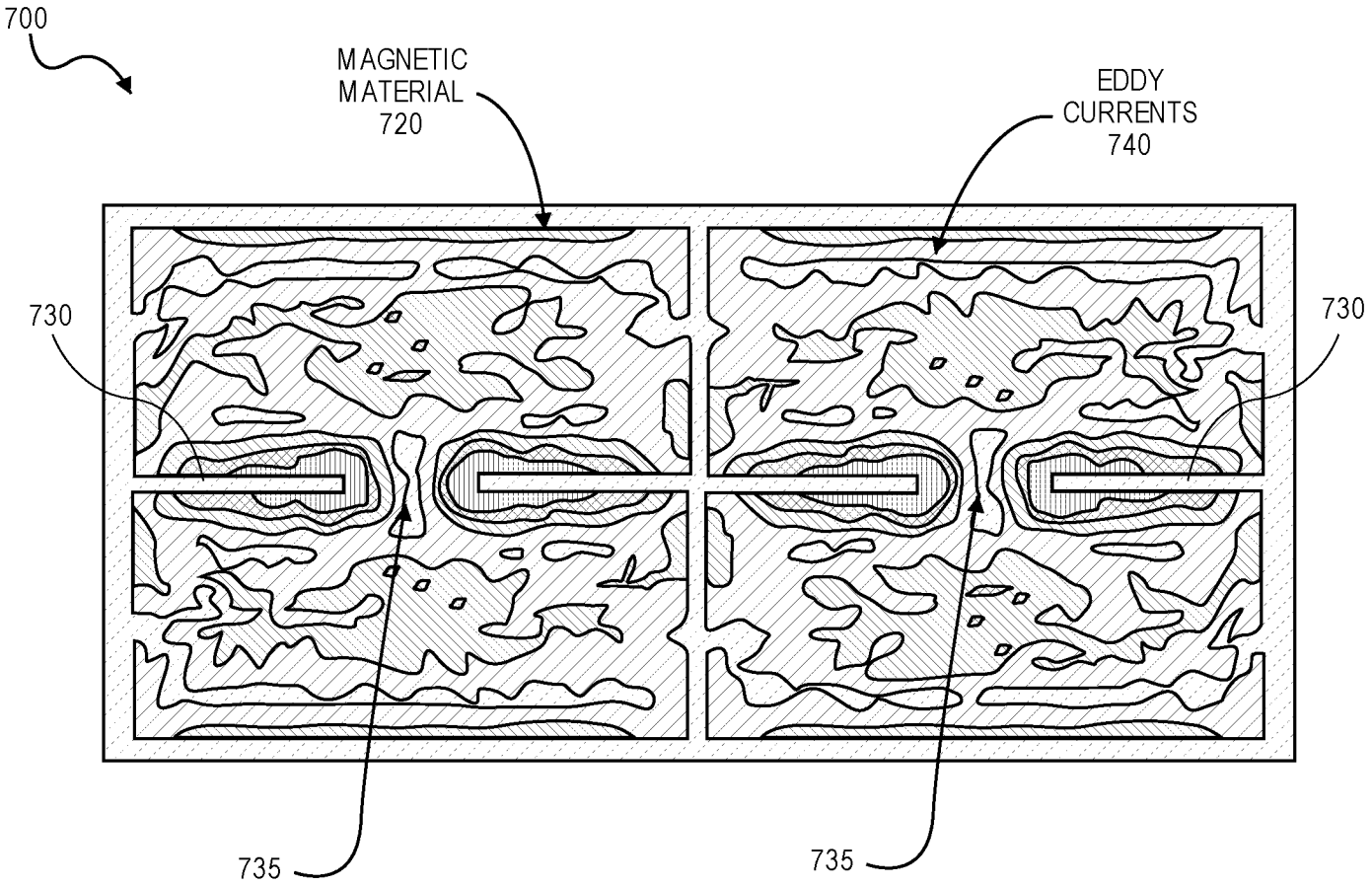
FIG. 7 is an illustration of an integrated inductor including a magnetic film material with partial gap separation according to an embodiment.

FIG. 7 is an illustration of an integrated inductor including a magnetic film material with partial gap separation according to an embodiment. In some embodiments, the magnetic material 720 of an integrated inductor 700 includes partial separation by partial slot portions 730, resulting in bridges of magnetic material 735. As illustrated in FIG. 7, the magnetic material 720 of a coupled integrated inductor (viewed from above) produces eddy currents 740. However, the eddy currents 740, in which the darker and denser lines indicate higher eddy current levels, are significantly reduced in comparison with the eddy currents 440 produced in the magnetic material 420 of an integrated inductor 400 without separation of the magnetic material, as illustrated in FIG. 4. In addition, rather than producing a large drop in inductance, as results from a complete separation of magnetic material, the inductance of the inductor is reduced by a lesser amount based on the existence of some magnetic material (the bridges of magnetic material) connecting the portions or sheets of the magnetic material. The degree of inductance reduction is traded off for improved efficiency, and can be chosen by the circuit designer through adjustment of the magnetic material of the inductor.

Figure 8:
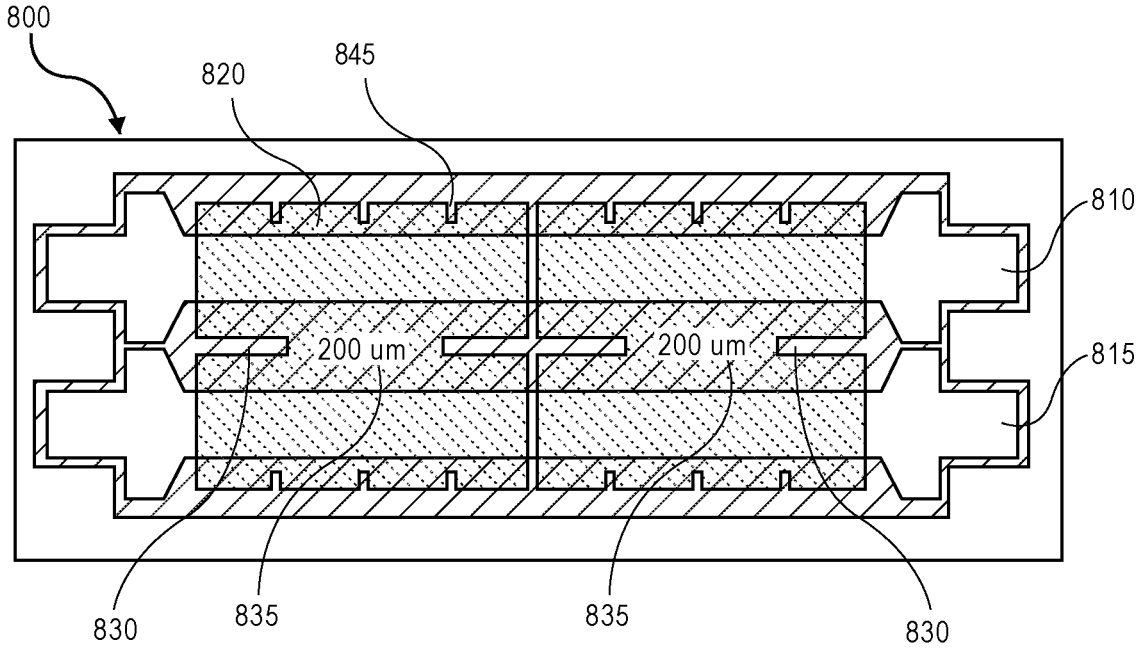
FIG. 8 is a representation of a microscopic image of an integrated inductor with a magnetic film material including a partial gap separation of the magnetic material and additional notch construction according to an embodiment.

FIG. 8 is a microscopic image of an integrated inductor with a magnetic film core including a partial gap separation of the magnetic material and additional notch construction according to an embodiment. As illustrated in FIG. 8, a coupled integrated inductor 800 includes conductors 810 and 815 surrounded above and below by magnetic material 820. In some embodiments, the magnetic material again includes partial slots 830 to partially separate the magnetic material 820 in the integrated inductor 800, the partial slots resulting in bridges 835 of the magnetic material 820. In some embodiments, the structure of the inductor 800 includes one or more notches 845 in the magnetic film. In some embodiments, there are multiple notches 845 along an outer periphery of the magnetic film, wherein each notch is approximately perpendicular to the partial slots and are relatively short in comparison with the partial slots 830 in the magnetic material 820. However, embodiments are not limited to this particular position and geometry of the notches in the magnetic material.

Figure 9:
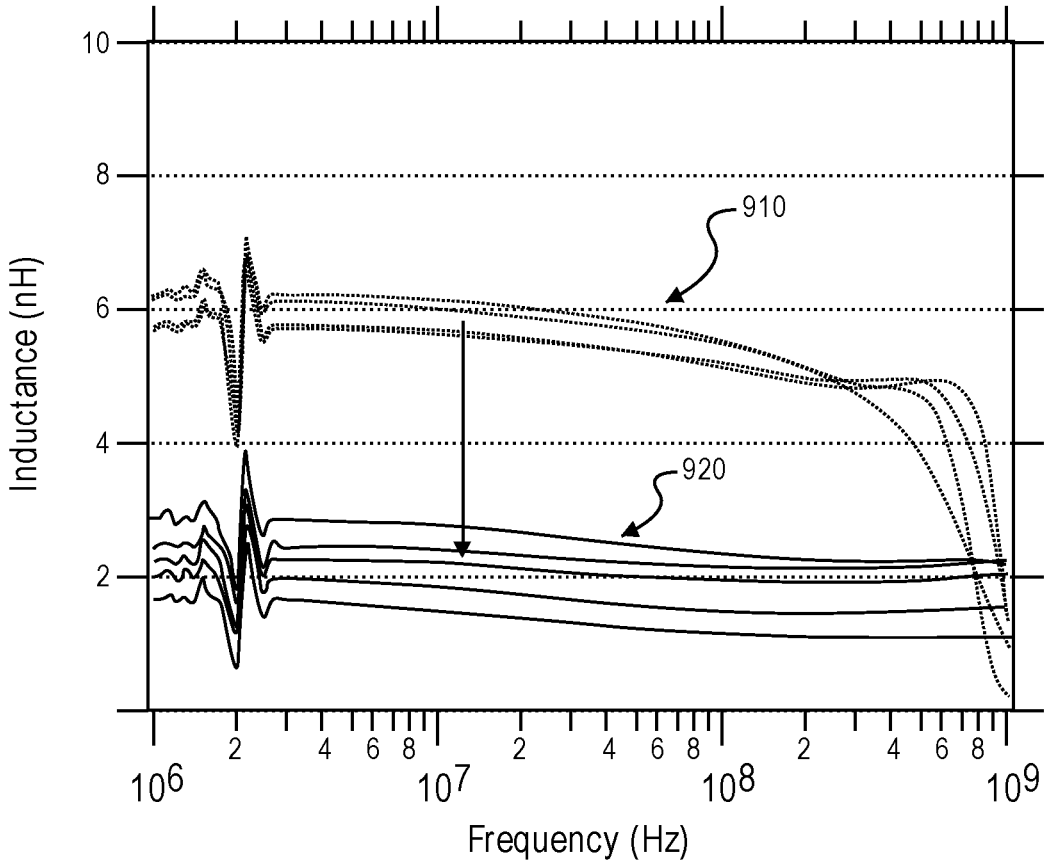
FIG. 9 is an illustration of measurements of the inductance versus frequency of strongly-coupled versus weakly-coupled transformer designs.

FIG. 9 is an illustration of measurements of the inductance versus frequency of strongly-coupled versus weakly-coupled transformer designs. Illustrated in FIG. 9 are the inductance versus frequency curves for varying inductors that are strongly coupled with no gaps in the magnetic material 910, such as illustrated in FIG. 5A, and inductors that are weakly coupled with full length gaps separating the magnetic material over the conductors 920, such as illustrated in FIG. 5B. As shown in FIG. 9, the introduction of a full lengthwise slot in the magnetic material results in a significant drop in the measured inductance by a factor of greater than two times, from approximately 4~5 nH (nanohenries) for the strongly coupled inductor measurements 910 to approximately 2 nH for the weakly coupled inductor measurements 920.

However, utilizing an embodiment of an H-gap structure in an inductor will result in a higher amount of inductance than a weakly-coupled structure, thereby better maintaining more of the inductance while improving the quality factor of the inductor.

Figure 10:
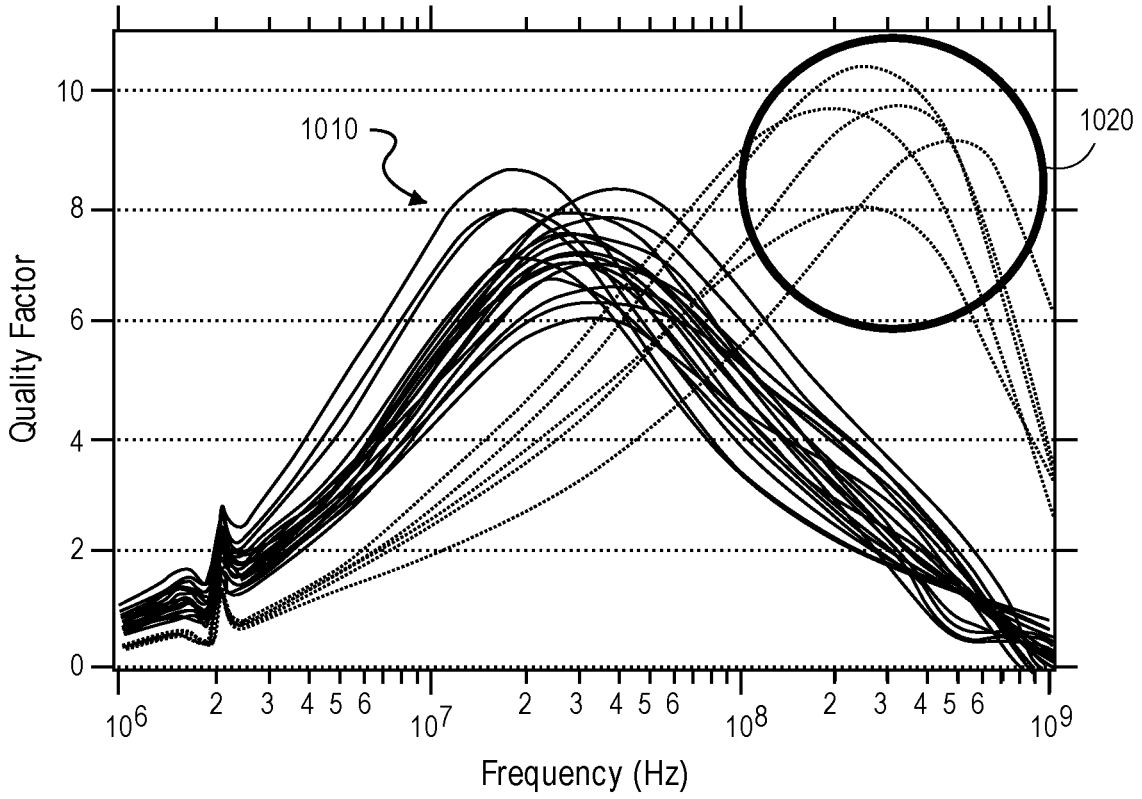
FIG. 10 is an illustration of measured quality factors for inductors utilizing varying structures according to an embodiment.

FIG. 10 is an illustration of quality factors for inductors utilizing varying structures according to an embodiment. FIG. 10 illustrates measured quality factors versus frequency for a strongly coupled inductor 1010 as compared to a weakly coupled inductor 1020. As shown in FIG. 10, the weakly coupled inductor measurements 1020 have a lower quality factor at lower frequencies (less than 100 MHz) than the strongly coupled inductor measurements 1010, but have a higher peak quality factor (at higher frequencies) in comparison with the strongly coupled inductors because of a lengthwise slot in the magnetic material that blocked the eddy currents. Further, as shown in FIG. 10, the frequency of the peak quality for the H-gap inductor measurements 1020 varies according to the particular implementation of the inductor, thereby enabling tuning of the frequency based on the design of the H-gap inductor.

Figure 11:
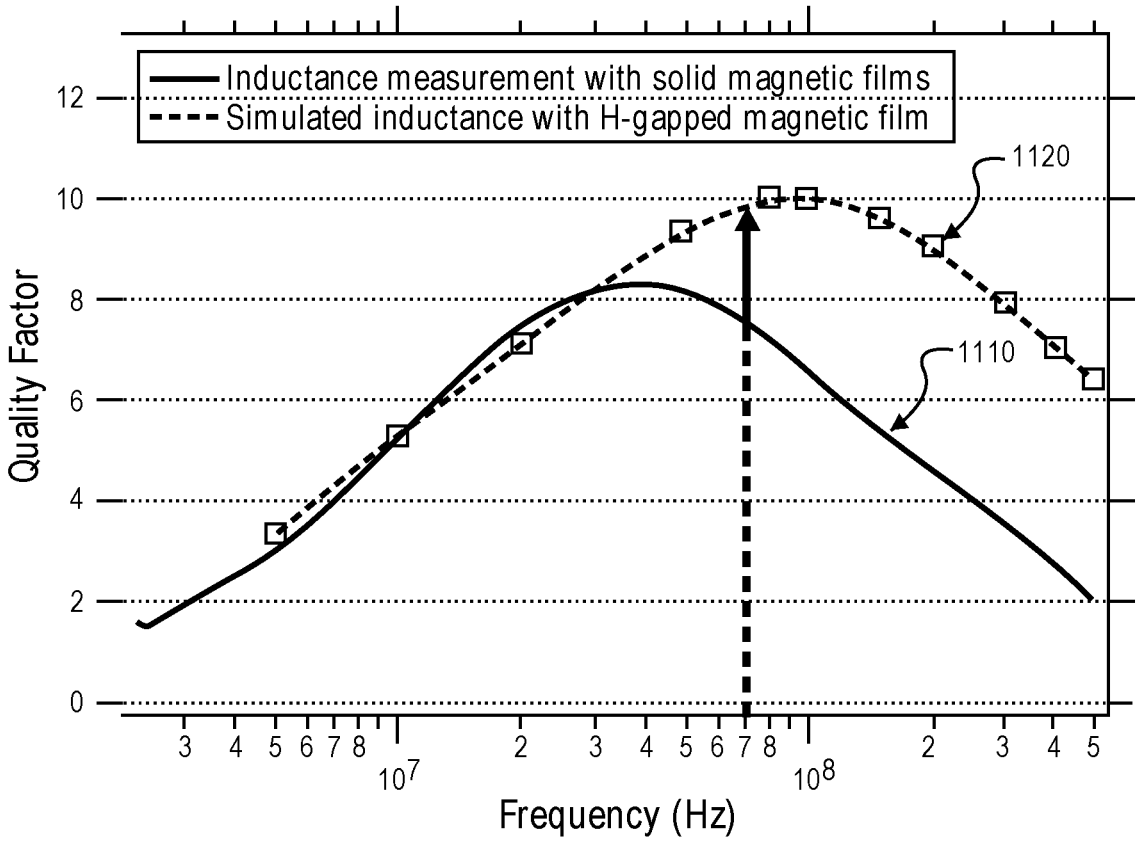
FIG. 11 is an illustration of measured and simulated quality factors for inductors utilizing varying structures according to an embodiment.

FIG. 11 is an illustration of quality factors for inductors utilizing varying structures according to an embodiment. FIG. 11 illustrates measured quality factors versus frequency for a strongly coupled transformer 1110 as compared to a simulation of an embodiment of an H-gap inductor 1120. As shown in FIG. 11, the H-gap inductor 1120 has a higher peak quality factor, resulting in reduced losses from the inductor and improved voltage converter efficiency.

Further, as shown in FIG. 11, the frequency of the peak quality for the H-gap inductor 1120 is shifted in frequency, to occur at a higher frequency. In this manner, an inductor may be designed and implemented for a particular frequency implementation through the modification of the H-gap structure of the inductor.

Figure 12:
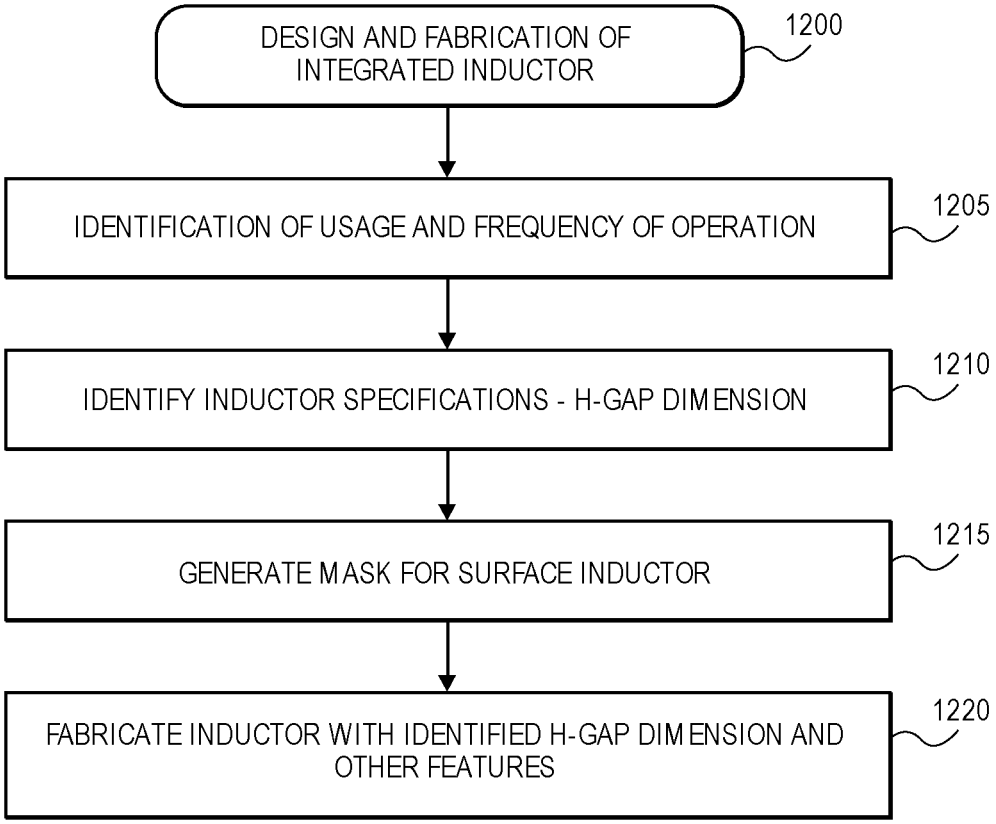
FIG. 12 is an illustration of a process for design and fabrication of an integrated inductor according to an embodiment.

FIG. 12 is an illustration of a process for design and fabrication of an integrated inductor according to an embodiment. In some embodiments, a process for design and fabrication of an integrated inductor 1200 may include identification of the usage and frequency of operation of the inductor 1205, wherein the ability of an embodiment H-gap inductor to produce an improved quality factor at a shifted frequency may be utilized to tune the inductor to the particular usage.

In some embodiments, upon identifying the usage and frequency of operation, the particular inductor specifications are identified, including identifying the gap dimension of an H-gapped inductor 1210. In some embodiments, the inductor specifications may include notches along an outer periphery of the magnetic material such as illustrated in FIG. 8 to further reduce eddy currents in the magnetic material of the inductor in operation.

In some embodiments, the process may further include generating a mask or other structure 1215 for fabrication of the magnetic material for the magnetic core of the integrated inductor. In some embodiments, the mask or other structure includes the design of an H-gap partial separation between portions of the magnetic material of a particular gap size, or, stated in another way, design of bridges in the magnetic material. In some embodiments, the mask or other structure further includes a series of notches in the magnetic material. In this manner, the structure of the integrated inductor for particular specifications may be designed and fabricated without requiring a modification of the fabrication process for the inductor.

In some embodiments, the process continues with the fabrication of the inductor, including the generation of the magnetic material core with the specified H-gap dimension and other features 1220.

Figure 13:
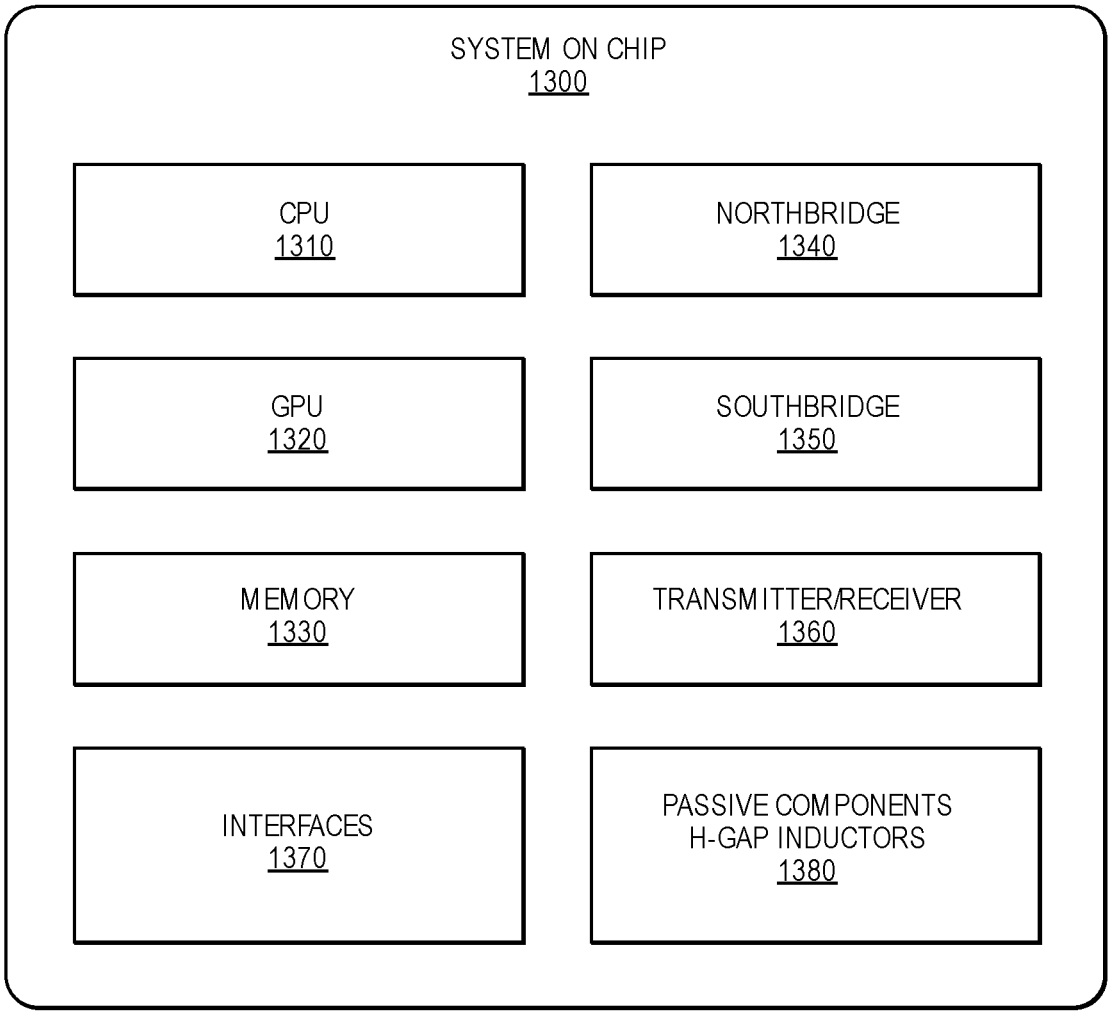
FIG. 13 is an illustration of a system on chip including an integrated inductor according to an embodiment.

FIG. 13 is an illustration of a system on chip including an integrated inductor according to an embodiment. In some embodiments, a system on chip (SoC) includes one or more passive components, including one or more H-gap integrated inductors 1380. In some embodiments, the integrated inductors may be utilized for power delivery, for a power amplifier, or for another use in which a magnetic material inductor is of value.

In some embodiments, the H-gap integrated inductors may be as illustrated in FIG. 6A, 6B, or 8, including a partial gap separation between magnetic material portions of the magnetic core of the integrated inductors. It is noted that FIG. 13 is an example of a particular usage of H-gap inductors, and embodiments of devices including implementation of H-gap inductors are not limited to SoC devices, but rather any device or packaged set of devices utilizing an integrated inductor to provide inductance in a circuit.

In some embodiments, the SoC 1300 may include, but is not limited to, the following:

(a) A central processing unit (CPU) or other processing element 1310 for the processing of data.

(b) A graphics processing unit (GPU) 1320 to create images for output to a display.

(c) Memory 1330, where memory may include random access memory (RAM) or other dynamic storage device or element as a main memory for storing information and instructions to be executed by the CPU 1310 and the GPU 1320. Main memory may include, but is not limited to, dynamic random access memory (DRAM). Memory 1330 may further include a non-volatile memory and a read only memory (ROM) or other static storage device for storing static information and instructions for the CPU 1310 and GPU 1320.

(d) A Northbridge 1340 to handle communications between the CPU and other component of the SoC. In some embodiments, the SoC 1300 may further include a Southbridge 1350 to handle I/O functions.

(e) A transmitter, receiver, or both 1360 for the transmission and reception of data via wired communications. Wireless communication includes, but is not limited to, Wi-Fi, Bluetooth™, near field communication, and other wireless communication standards.

(f) One or more interfaces 1370, including USB (Universal Serial Bus, Firewire, Ethernet, or other interfaces.

In the description above, for the purposes of explanation, numerous specific details are set forth in order to provide a thorough understanding of the described embodiments. It will be apparent, however, to one skilled in the art that embodiments may be practiced without some of these specific details. In other instances, well-known structures and devices are shown in block diagram form. There may be intermediate structure between illustrated components. The components described or illustrated herein may have additional inputs or outputs that are not illustrated or described.

Various embodiments may include various processes. These processes may be performed by hardware components or may be embodied in computer program or machine-executable instructions, which may be used to cause a general-purpose or special-purpose processor or logic circuits programmed with the instructions to perform the processes. Alternatively, the processes may be performed by a combination of hardware and software.

Portions of various embodiments may be provided as a computer program product, which may include a computer-readable medium having stored thereon computer program instructions, which may be used to program a computer (or other electronic devices) for execution by one or more processors to perform a process according to certain embodiments. The computer-readable medium may include, but is not limited to, magnetic disks, optical disks, read-only memory (ROM), random access memory (RAM), erasable programmable read-only memory (EPROM), electrically-erasable programmable read-only memory (EEPROM), magnetic or optical cards, flash memory, or other type of computer-readable medium suitable for storing electronic instructions. Moreover, embodiments may also be downloaded as a computer program product, wherein the program may be transferred from a remote computer to a requesting computer.

Many of the methods are described in their most basic form, but processes can be added to or deleted from any of the methods and information can be added or subtracted from any of the described messages without departing from the basic scope of the present embodiments. It will be apparent to those skilled in the art that many further modifications and adaptations can be made. The particular embodiments are not provided to limit the concept but to illustrate it. The scope of the embodiments is not to be determined by the specific examples provided above but only by the claims below.

If it is said that an element "A" is coupled to or with element "B," element A may be directly coupled to element B or be indirectly coupled through, for example, element C. When the specification or claims state that a component, feature, structure, process, or characteristic A "causes" a component, feature, structure, process, or characteristic B, it means that "A" is at least a partial cause of "B" but that there may also be at least one other component, feature, structure, process, or characteristic that assists in causing "B." If the specification indicates that a component, feature, structure, process, or characteristic "may", "might", or "could" be included, that particular component, feature, structure, process, or characteristic is not required to be included. If the specification or claim refers to "a" or "an" element, this does not mean there is only one of the described elements.

An embodiment is an implementation or example. Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. It should be appreciated that in the foregoing description of exemplary embodiments, various features are sometimes grouped together in a single embodiment, figure, or description thereof for the purpose of streamlining the disclosure and aiding in the understanding of one or more of the various novel aspects. This method of disclosure, however, is not to be interpreted as reflecting an intention that the claimed embodiments requires more features than are expressly recited in each claim. Rather, as the following claims reflect, novel aspects lie in less than all features of a single foregoing disclosed embodiment. Thus, the claims are hereby expressly incorporated into this description, with each claim standing on its own as a separate embodiment.

In some embodiments, an inductor includes a first conductor and a second conductor; one or more strips of magnetic film, including a first strip of magnetic material film, below the first conductor and the second conductor; and one or more strips of magnetic film, including a second strip of magnetic material film, above the first conductor and the second conductor. In some embodiments, at least one of the first strip of magnetic material and the second strip of magnetic material includes a partial slot to partially separate a first section of the strip of magnetic material and a second section of the strip of magnetic material, In some embodiments, the partial slot includes a first slot portion, a second slot portion, and a bridge of magnetic material between the first slot portion and the second slot portion.

In some embodiments, the partial slot creates a partial lengthwise separation of the strip of magnetic material.

In some embodiments, the first slot portion begins at a first end of the strip of magnetic material and the second slot portion begins at a second, opposite end of the strip of magnetic material.

In some embodiments, the first slot portion and the second slot portion are approximately parallel to the first conductor and the second conductor.

In some embodiments, a width of the bridge may be set to modify magnetic coupling of the inductor.

In some embodiments, setting the width of the bridge includes modification of a mask layout for fabrication of the inductor.

In some embodiments, the width of the bridge is at least 20 percent and no more than 80 percent of a total length of the magnetic material.

In some embodiments, the width of the bridge is no more than 50 percent of a total length of the magnetic material.

In some embodiments, the inductor further includes a plurality of notches in the magnetic material. In some embodiments, the plurality of notches are along an outer periphery of the magnetic material. In some embodiments, the notches are approximately perpendicular to the partial slot.

In some embodiments, the inductor includes two or more strips of magnetic material film below the first conductor and the second conductor or two or more strips of magnetic material film above the first conductor and the second conductor, and wherein each of the two or more of the strips of magnetic material above or below the first conductor and second conductor includes a partial slot to partially separate a first section of the strip of magnetic material and a second section of the strip of magnetic material.

In some embodiments, an apparatus includes a microelectronic circuit and an integrated inductor, the integrated inductor to provide inductance for the microelectronic circuit, the integrated inductor including a first conductor and a second conductor, one or more strips of magnetic film including a first strip of magnetic material film below the first conductor and the second conductor, and one or more strips of magnetic film including a second strip of magnetic material film above the first conductor and the second conductor. In some embodiments, at least one of the first strip of magnetic material and the second strip of magnetic material includes a partial slot to partially separate a first section of the strip of magnetic material and a second section of the strip of magnetic material, In some embodiments, the partial slot of the integrated inductor includes a first slot portion, a second slot portion, and a bridge of magnetic material between the first slot portion and the second slot portion.

In some embodiments, the partial slot creates a partial lengthwise separation of the strip of magnetic material.

In some embodiments, a width of the bridge may be set to modify magnetic coupling of the integrated inductor.

In some embodiments, setting the width of the bridge includes modification of a mask layout for fabrication of the integrated inductor.

In some embodiments, the integrated inductor is utilized in one of power delivery or power amplification for the apparatus.

In some embodiments, the integrated inductor is integrated within the microelectronic circuit. In some embodiments, the microelectronic circuit is a system on chip (SoC) or system on package (SoP).

In some embodiments, the integrated inductor is integrated in a substrate separate from the microelectronic circuit.

In some embodiments, the integrated inductor further includes a plurality of notches in the magnetic material.

In some embodiments, a method for fabricating an inductor with adjustable coupling includes identifying one or more specifications for an inductor, the inductor including a first conductor and a second conductor, one or more strips of magnetic film including a first strip of magnetic material film below the first conductor and the second conductor, and one or more strips of magnetic film including a second strip of magnetic material film above the first conductor and the second conductor; and generating a mask for the fabrication of the inductor based on the specification of the inductor; and fabricating the inductor using the mask. In some embodiments, the generation of the mask is to adjust a coupling of the magnetic material of the inductor by providing a layout for the inductor that includes a partial slot separating a first section of magnetic material and a second section of magnetic material.

In some embodiments, the partial slot of the inductor includes a first slot portion, a second slot portion, and a bridge of magnetic material between the first slot portion and the second slot portion, and wherein the mask is to establish a width of the bridge of magnetic material.

In some embodiments, establishing the width of the bridge includes establishing the width to be at least 20 percent and no more than 80 percent of a total length of the magnetic material. In some embodiments, establishing the width of the bridge includes establishing the width to be no more than 50 percent of a total length of the magnetic material.

In some embodiments, generating the mask is to further provide the layout for the inductor including a plurality of notches in the magnetic material.

What is claimed is:

1. An inductor comprising:

a first conductor and a second conductor;

one or more strips of magnetic film, including a first strip of magnetic material film, below the first conductor and the second conductor; and one or more strips of magnetic film, including a second strip of magnetic material film, above the first conductor and the second conductor;

wherein the second strip of magnetic material film includes a first slot to completely separate a first section of the second strip of magnetic material film and a second section of the second strip of magnetic material film, the first slot between the first conductor and the second conductor, wherein the first slot is approximately parallel to the first conductor and the second conductor, wherein the second strip of magnetic material film further includes a second slot, the second slot perpendicular to the first slot and the second slot perpendicular to and across the first conductor and the second conductor in an approximately central location of the first slot, and wherein the first strip of magnetic material film does not include a slot to completely separate a first section of the first strip of magnetic material film and a second section of the first strip of magnetic material film.

2. The inductor of claim 1, further comprising a plurality of notches in the second strip of magnetic material film.

3. The inductor of claim 2, wherein the plurality of notches are along an outer periphery of the second strip of magnetic material film.

4. The inductor of claim 3, wherein the notches are approximately perpendicular to the first slot.

5. An apparatus comprising:

a microelectronic circuit; and an integrated inductor, the integrated inductor to provide inductance for the microelectronic circuit, the integrated inductor including:

a first conductor and a second conductor;

one or more strips of magnetic film, including a first strip of magnetic material film, below the first conductor and the second conductor; and one or more strips of magnetic film, including a second strip of magnetic material film, above the first conductor and the second conductor;

wherein the second strip of magnetic material film includes a first slot to completely separate a first section of the second strip of magnetic material film and a second section of the second strip of magnetic material film, the first slot between the first conductor and the second conductor, wherein the first slot is approximately parallel to the first conductor and the second conductor, wherein the second strip of magnetic material film further includes a second slot, the second slot perpendicular to the first slot and the second slot perpendicular to and across the first conductor and the second conductor in an approximately central location of the first slot, and wherein the first strip of magnetic material film does not include a slot to completely separate a first section of the first strip of magnetic material film and a second section of the first strip of magnetic material film.

6. The apparatus of claim 5, wherein the integrated inductor is utilized in one of power delivery or power amplification for the apparatus.

7. The apparatus of claim 5, wherein the integrated inductor is integrated within the microelectronic circuit.

8. The apparatus of claim 5, wherein the integrated inductor further includes a plurality of notches in the second strip of magnetic material film.

* * * * *